US006164795A

United States Patent [19]

Lopez

[11] Patent Number: 6,164,795

[45] Date of Patent: Dec. 26, 2000

[54] UNIVERSAL KEY HOLDER WITH LIGHT

[76] Inventor: Fidel Lopez, 6103 SW. 137 Ct., Kendall, Fla. 33183

[21] Appl. No.: 09/316,765

[22] Filed: May 21, 1999

[51] Int. Cl.[7] ..... F21V 33/00

[52] U.S. Cl. ..... 362/116; 362/253

[58] Field of Search ..... 362/116, 253, 362/200, 208, 157

[56] References Cited

U.S. PATENT DOCUMENTS

| | | | |
|---|---|---|---|
| 4,276,582 | 6/1981 | Burnett | 362/116 |
| 4,392,186 | 7/1983 | Cziment | 362/116 |
| 4,521,833 | 6/1985 | Wolter | 362/116 |
| 5,487,291 | 1/1996 | Voigt | 362/116 |
| 5,541,817 | 7/1996 | Hung | 362/116 |

*Primary Examiner*—Thomas M. Sember
*Attorney, Agent, or Firm*—J. Sanchelima

[57] ABSTRACT

A universal holder for keys with an illuminated member that projects a beam of light substantially parallel to the direction of the key being housed by the holder. One end of the key protrudes outside the holder while the other end is housed within the holder sandwiched by two pad members. Two substantially similar sections joined together by an integral hinge with opposing cavities that receive the pad members. The pad members are deformable and conform to the dimensions of the cavities providing a firm grip on the key avoiding any internal play. Keys with different configurations can be thus accommodated. A battery operated circuit is closed with membrane switches that cause the light element to produce a light beam.

6 Claims, 3 Drawing Sheets

UNIVERSAL KEY HOLDER WITH LIGHT

BACKGROUND OF THE INVENTION

1. Field of the Invention

The present invention relates to an illuminated key holder.

2. Description of the Related Art

There are many designs for key holders. Some of them include luminous elements. None of them, however, provide for a universal key holder that accepts keys with different dimensions.

Applicant believes that the closest reference corresponds to U.S. Pat. No. 5,541,817 issued to Hung (1996). However, it differs from the present invention because the patented invention requires the molding of plate 30 with blade 20. The present invention provides a universal solution for most key configurations.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a key holder that can be used universally with most key configurations, enlarging the effective area for turning it while providing a light source to aid a user in finding the keyhole.

It is another object of this invention to provide a key holder that is volumetrically efficient.

It is still another object of the present invention to provide a key holder that can be readily opened and batteries changed.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
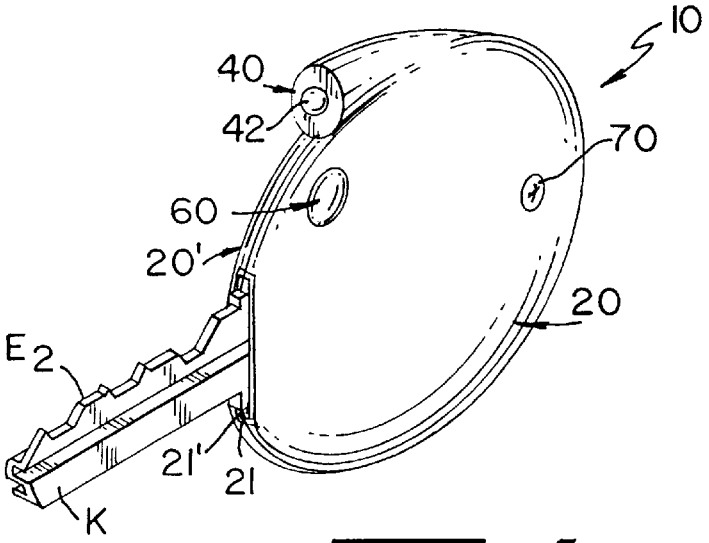
FIG. 1 represents an isometric view of one of the preferred embodiment.
Figure 2:
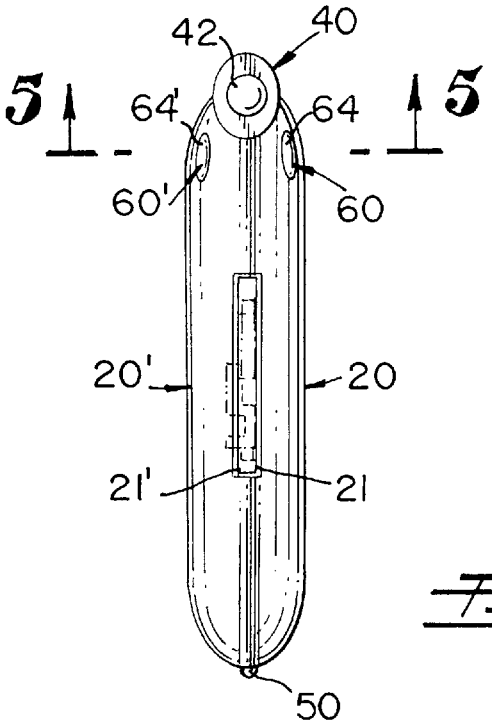
FIG. 2 shows a front view of the housing with a key shown in phantom.

Referring now to the drawings, where the present invention is generally referred to with numeral 10, it can be observed that it basically includes two substantially symmetrical sections 20 and 20' for trapping or sandwiching one end of key K, and including lighted assembly 40 for producing a beam of light when switch assembly 60 is activated.

Figure 3:
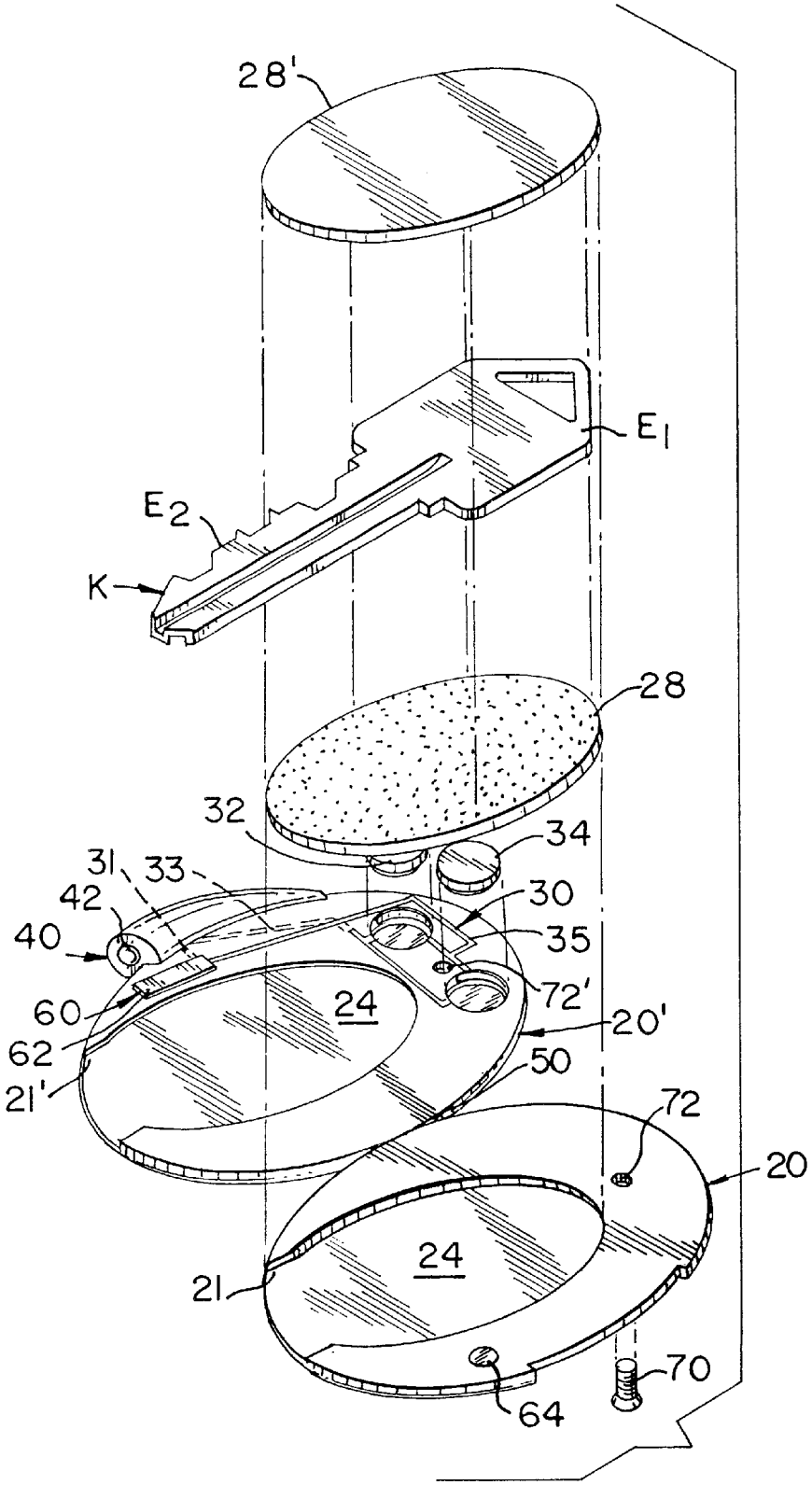
FIG. 3 illustrates an exploded view for the embodiment shown in the previous figures.
Figure 4:
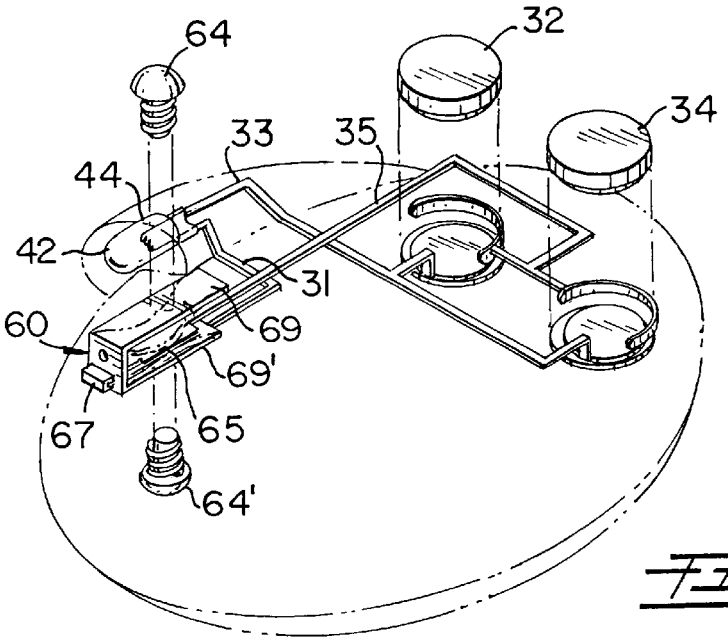
FIG. 4 is an exploded partial view of the embodiment shown in the previous figures.

Sections 20 and 20' have, in the preferred embodiment, a substantially round or oval periphery with lens member 42 tangentially mounted to direct a light beam preferably parallel to the protruding end of key K. One of the applications for the light beam is to help a user find the keyhole in unlighted or poorly lighted areas. Sections 20 and 20' are joined together at one common portion of their respective edge with integral hinge 50, as best seen in FIG. 3. Sections 20 and 20' are brought together with a water tight engagement.

Cavities 24 and 24' have sufficiently large dimensions to house the handling end E1 of key K and include cut-outs 26 and 26' through which the protruding end E2 of key K goes through.

Pad members 28 and 28' conform to the contour of cavities 24 and 24', respectively, and they are made out of a deformable, yet somewhat resilient material, that permits a tight grip to end E1 of key K. One of such products is a strong mounting double stick product manufactured by 3M of St. Paul, Minn. under the Scotch brand.

Figure 6:
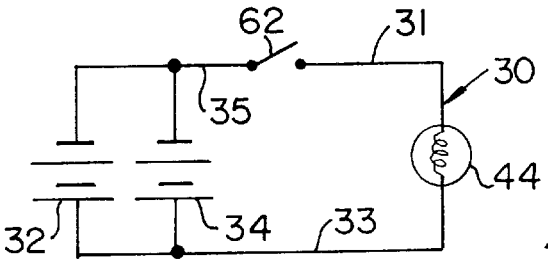
FIG. 6 is a representation of the circuitry of the present invention.
Figure 5:
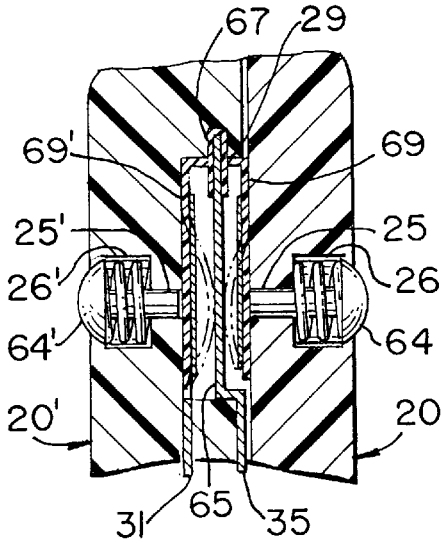
FIG. 5 is a partial cross-sectional view showing the switch assembly taking along line 5—5 in FIG. 2.

In the preferred embodiment, two batteries 32 and 34 are connected in parallel to each other and through printed circuit conductors 31; 33 and 35 in series with switch member 62 and light member 64, as represented in FIG. 6. The connections are made preferably with printed circuit connection on the inner surface of section 20'.

Switch member 62, in the preferred embodiment, includes two symmetrical spring loaded actuators 64 and 64' housed within respective bores 25 and 25' that includes counterbores 26 and 26', respectively. Bores 25 and 25' connect with switch cavity 29 that includes centrally disposed switch contact 65 held in place by insulate d U-shape plate 67 at one end and the end is affixed to section 20' as an extension of printed circuit 31. Laterally disposed switch contacts 69 and 69' are of the flexible membrane type cooperate with actuators 64 and 64' to bring the former in contact with centrally disposed switch contact 65 upon the application of a predetermined amount of force on the latter. In this manner, the electrical circuit is closed causing light to be emitted by light member 44.

Fastening member 70 is passed through cooperating through opening 72 and engages with threaded opening 72' to firmly keep sections 20 and 20' together. Conversely, separating sections 20 and 20' is a relatively simple operation.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A holder for keys, comprising:

A) housing means comprising first and second sections peripherally joined together at one portion defining an integral hinge, and said first and second sections including, respectively, first and second symmetrical cavities, having each a cut-out for receiving a key with two ends and housing one end while permitting the other end to protrude through said cut-outs outside said housing means;

B) padding means conforming to said first and second cavities sandwiching one of the ends of a key on both sites thereby providing a firm grip thereon; and C) illuminating means peripherally mounted to said housing means including battery means for powering said illuminating means and further including switch means for selectively interrupting the electrical circuit powering said illuminating means.

2. The holder set forth in claim 1 wherein said switch means including a flexible membrane switch member.

3. The holder set forth in claim 2 wherein said switch means includes at least one spring loaded actuator for activating said switch means.

4. The holder set forth in claim 3 wherein said first section includes a third cavity for housing said battery means.

5. The holder set forth in claim 4 wherein said first section includes a fourth cavity for housing said switch means.

6. The holder set forth in claim 5 further including:

D) fastening means for keeping said first and second sections joined together.

* * * * *